United States Patent [19]

Meyer

[11] Patent Number: 4,475,321

[45] Date of Patent: Oct. 9, 1984

[54] METHOD OF TRUEING OF GRINDING DISKS

[75] Inventor: Hans-Robert Meyer, Hamburg, Fed. Rep. of Germany

[73] Assignee: Ernst Winter & Sohn GmbH & Co., Hamburg, Fed. Rep. of Germany

[21] Appl. No.: 572,957

[22] Filed: Jan. 23, 1984

Related U.S. Application Data

[63] Continuation of Ser. No. 303,711, Sep. 18, 1981, abandoned.

[30] Foreign Application Priority Data

Sep. 20, 1980 [DE] Fed. Rep. of Germany ..... 3035635

[51] Int. Cl.[3] ..... B24B 1/00

[52] U.S. Cl. ..... 51/325; 125/11 CD

[58] Field of Search ..... 125/11 CD, 11 R; 51/325

[56] References Cited

U.S. PATENT DOCUMENTS

| | | | |
|---|---|---|---|
| 2,528,621 | 11/1950 | Sweetger | 125/11 CD |
| 3,971,358 | 7/1976 | Sawluck | 51/325 |
| 4,151,684 | 5/1979 | Wade | 125/11 CD |
| 4,182,082 | 1/1980 | Meyer | 125/11 CD |
| 4,235,218 | 11/1980 | Iida | 125/11 CD |
| 4,259,940 | 4/1981 | Asano | 125/11 CD |

FOREIGN PATENT DOCUMENTS

| | | | |
|---|---|---|---|
| 141486 | 11/1979 | Japan | 125/11 CD |

*Primary Examiner*—Harold D. Whitehead
*Attorney, Agent, or Firm*—Michael J. Striker

[57] ABSTRACT

A method of trueing grinding disks comprises the steps of engaging the outer layer of a grinding disk during rotation thereof with a predetermined speed with a driven diamond trueing roll and spaced from the trueing roll with a trueing disk having a peripheral speed of 0.5–6 meters per second and preferably 1 meter per second relative to the peripheral speed of the grinding disk. The trueing of the grinding disk can be performed while the grinding disk grinds a workpiece.

4 Claims, 1 Drawing Figure

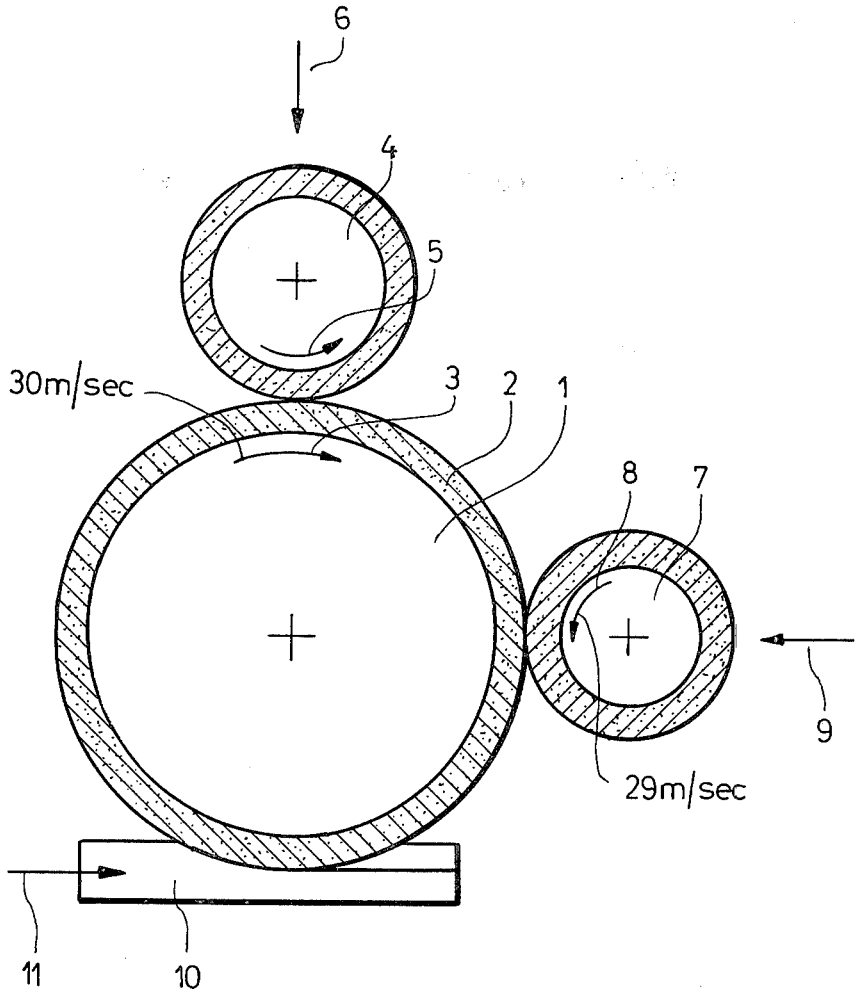
6
4
5
30m/sec
3
2
1
8
7
9
29m/sec
11
10

METHOD OF TRUEING OF GRINDING DISKS

This is a continuation of application Ser. No. 303,711, filed Sept. 18, 1981 now abandoned.

BACKGROUND OF THE INVENTION

The present invention relates to a method for trueing grinding disks having an outer layer with diamonds or cubic crystalline boron nitride using a driven trueing roll and an additional trueing aid.

Profiled diamond grinding disks are, during production thereof pre-profiled by a pressing step and subsequently ground with ceramic disks such as silicon carbide grinding disks. This is, however, an expensive method, and subsequent profiling must be carried out by the producer of the disk. Therefore, it is already known to provide for the use of profiled grinding disks with diamond or cubic crystalline boron nitride in galvanic binding only one layer of grain, whereby however such disks after loss of their exact form cannot be used any longer.

The use of trueing respectively profiling rolls of steel or hard metal is known for the trueing and profiling of corundum or silicon carbide grinding disks with ceramic binding. Such a profil roll presses during each revolution of the grinding disk onto the grinding grains which project farthest from the binding. These grinding grains partly break under the applied pressure out of the brittle binding material of the grinding disk and are pressed partly into the grinding surface of the disk. Also known are profile rolls of silicon carbide in ceramic or bakelitic binding for the trueing of grinding disks (U.S. Pat. No. 2,456,762) which are, however, usable only for grinding disks with diamonds in ceramic or bakelitic binding material. Diamond tools, such as diamond trueing rolls, are usually used for trueing of grinding disks with corundum or silicon carbide, which tools, in view of their greater hardness, permit to provide such grinding disk with the necessary profile.

Further known is the trueing of a diamond grinding disk using a so-called crushing roll, which has no diamond layer and which is at slow circumferential speed pressed against the grinding disk to be trued, which is rotated with the same circumferential speed. With such a crushing roll it is possible to true grinding disks with diamond or with cubic crystalline boron nitride, but an additional trueing aid is thereby advisable which consists of corundum in ceramic binding and therefore is relatively soft and accordingly adapts itself easily to the profile. In a known method (German Auslegeschrift No. 25 34 872) such a stationary trueing aid is pressed with constant pressure against the grinding disk. Thereby an addition to the grinding surface due to compression during the rolling in of the profile shall be avoided, in that the grain of the grinding disk which at first has been pressed by the stationary trueing stone into the peripheral surface of the grinding disk, are again removed from the binding thereof, to thereby provide an improved peripheral surface, or a greater grinding output. The trueing stone is therefore given the task to clean the peripheral surface of the grinding disk from crushed binding and broken out grain particles.

Grinding disks with an outer layer or cubic crystalline boron nitride or diamond particles, which are trued by diamond trueing rolls, show after trueing not a sufficient grinding capacity. This results especially from the fact that, during the cutting of the cubic crystalline grains with diamond, surfaces are produced on these cubic crystalline grains which impair the grinding capacity. To assure that the grains project slightly beyond the binding material, which is necessary for the removal of the shavings during the grinding, there has been up to now, after trueing of the diamond grinding disk with a diamond trueing roll, a reworking carried out, for instance by use of the above-described stationary trueing stone, with which the binding material has been set back so that the individual grains of the grinding disk project partly beyond the binding to thereby create a shaving space between the individual grains. This method has, however, shown itself to be imperfect in practice. If for instance the grinding disk has to be provided with a thread profile, the teeth of which end with a sharp edge, then, by subsequent use of the stationary trueing aid a rounding of the tooth edges is produced, which is highly undesirable. This is due to the fact that, by the subsequent use of a stationary trueing aid, it is impossible, due to the high relative speed between the trueing aid and the grinding disk, to receive a sufficient projection of the cubic crystalline boron nitride grains beyond the peripheral surface of the binding material, for instance if the peripheral speed of the grinding disk is 30 meters per second.

SUMMARY OF THE INVENTION

It is an object of the present invention to improve the efficiency of known trueing aids to thereby create the possibility to profile diamond grinding disks or grinding disks with cubic crystalline boron nitride with diamond trueing rolls and to carry out such profiling also during grinding of a workpiece.

With these and other objects in view, which will become apparent as the description proceeds, the method according to the present invention for trueing a grinding disk having an outer layer with diamond or cubic crystalline boron nitride during rotation thereof at a predetermined circumferential speed comprises the steps of engaging this outer layer with a driven diamond trueing roll and spaced from the trueing roll with an additional driven trueing disk rotating with a relative peripheral speed of 0.5–6 meters per second relative to the peripheral speed of the grinding disk. If such a relative speed is provided between the trueing disk and the grinding disk profiled by the diamond trueing roll, in the magnitude of preferably 1 meter per second, then this relative speed is sufficient to assure that the grains of the grinding disk will project sufficiently beyond the binding material thereof. The diamond trueing roll can thereby be rotated with a different speed than the grinding disk, whereby it is usually advantageous during the pre-profiling of the grinding disk to rotate the latter and the diamond trueing roll in the same direction, whereas during finish profiling of the grinding disk the latter is preferably rotated in a direction opposite to the rotation of the trueing roll, to thereby provide already a certain projection of the grains of the grinding disk beyond the binding material. This grain projection is then increased by the with smaller relative speed rotating trueing disks to the desired dimension.

The method according to the present invention has the additional advantage that it is possible during grinding of a workpiece to carry out a continuous re-profiling to the necessary extent.

The additionally driven trueing disk has an outer layer of ceramically or bakelitically bound silicon carbide or an outer layer of ceramically or bakelitically bound corundum. The use of such a material has the advantage that the trueing disk will continuously adapt itself to the profile of the grinding disk, which is continuously produced by the diamond trueing roll so that the trueing disk will not subsequently enter into the profile of the grinding disk to thereby, for instance, remove the points of toothed profiles.

The novel features which are considered characteristic for the invention are set forth in particular in the appended claims. The invention itself, however, both as to its construction and its method of operation, together with additional objects and advantages thereof, will be best understood from the following description of preferred embodiments when read in connection with the accompanying drawing.

BRIEF DESCRIPTION OF THE DRAWING

The single FIGURE of the drawing schematically illustrates an arrangement for carrying out the method according to the present invention.

DESCRIPTION OF THE PREFERRED EMBODIMENT

The grinding disk 1 shown in the drawing is provided with an outer layer of diamond or cubic crystalline boron nitride and rotated in clockwise direction as indicated by the arrow 3. A diamond trueing roll 4 is provided for trueing and profiling the grinding disk 1, and the trueing roll 4 rotates in counterclockwise direction as indicated by the arrow 5, whereby preferably a relative speed between diamond trueing roll 4 and the grinding disk 1 is maintained. The diamond roll 4 is moved against the periphery of the grinding disk 1 in the direction as indicated by the arrow 6.

A trueing disk 7 is provided as additional trueing aid, and the disk 7 is rotated in clockwise direction as indicated by the arrow 8. The trueing disk 7 is pressed with a constant force in the direction of the arrow 9 against the periphery of the grinding disk 1 to engage the periphery of the latter along a line spaced in direction of the arrow 3 from the line of engagement between the diamond trueing roll 4 and the grinding disk 1. The trueing disk 7 has an outer layer of ceramically or bakelitically bound silicon carbide or corundum. The trueing disk 7 is rotated for instance with a peripheral speed of 29 meters per second, when the grinding disk is driven with a peripheral speed of 30 meters per second, so that the relative speed between grinding disk 1 and trueing disk 4 is 1 meter per second. Due to this small relative speed it is possible during trueing of the grinding disk at high peripheral speed by means of the diamond trueing roll 4 to obtain a slight projection of the individual grains beyond the binding, while the grinding disk 1 grinds a workpiece 10, which according to the arrow 11 is fed into engagement the grinding disk.

It will be understood that each of the elements described above, or two or more together, may also find a useful application in other types of methods for trueing grinding disks different from the types described above.

While the invention has been illustrated and described as embodied in a method for trueing grinding disks having an outer layer of diamond or cubic crystalline boron nitride and which is first engaged by a driven diamond trueing roll and spaced therefrom by an additional driven trueing disk rotated with a relative peripheral speed of 0.5–6 meters per second relative to the peripheral speed of the grinding disk, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for trueing a grinding disk having an outer layer of diamond or cubic crystalline boron nitride during rotation thereof with a predetermined circumferential speed, comprising the steps of engaging said outer layer of said grinding disk with a driven but axially immovable diamond trueing roll so as to profile and true said layer; and directly engaging said outer layer of said grinding disk at a location spaced from said trueing roll with an additional separately driven trueing disk with an outer layer of ceramically or bakelitically bound silicon carbide or corundum, rotating with a relative peripheral speed of 0.5–1.0 meters per second relative to the peripheral speed of said grinding disk and continuously adapting itself to said profile of said grinding disk so as not to enter and alter said profile but to offset the binder relative to a working surface of the grains of said grinding disks.

2. The method as defined in claim 1, wherein the trueing of the grinding disk is performed with a relative speed between said trueing disk and said grinding disk of 0.5–0.6 meter per second.

3. A method as defined in claim 1, wherein said true disk is pressed with a constant force against said outer layer of said grinding disk.

4. A method as defined in claim 1, wherein said trueing of said grinding disk by said trueing roll and said trueing disk is performed while said grinding disk grinds a workpiece.

* * * * *